US005165118A

United States Patent [19]

Cendrowski

[11] Patent Number: 5,165,118

[45] Date of Patent: Nov. 24, 1992

[54] SINK STRAINER ASSEMBLY WITH SNAP LOCK

[75] Inventor: Joseph E. Cendrowski, Berea, Ohio

[73] Assignee: Guarantee Specialties, Inc., Cleveland, Ohio

[21] Appl. No.: 729,598

[22] Filed: Jul. 15, 1991

[51] Int. Cl.[5] ..... A47K 1/14; E03C 1/26

[52] U.S. Cl. ..... 4/287; 4/286; 4/288

[58] Field of Search ..... 4/287, 286, 288, 290, 4/291, 292, 293, 295; 220/306, 307, 308, 326, 345, 347, 348, DIG. 6, 234, 315; 74/527; 24/617, 136 L, 115 G, 103, 588, 594, 595, 706; 138/89, 96 R; 251/297

[56] References Cited

U.S. PATENT DOCUMENTS

| | | | |
|---|---|---|---|
| 1,760,659 | 5/1930 | Pasman | 4/287 |
| 1,859,821 | 5/1932 | Ebinger | 4/287 |
| 2,278,566 | 4/1942 | Schaible | 4/288 |
| 2,668,962 | 2/1954 | Spector | 4/287 |
| 3,525,105 | 8/1970 | Richards | 4/287 |
| 4,103,372 | 8/1978 | Cuschera | 4/287 |
| 4,586,203 | 5/1986 | Westgerdes | 4/287 |
| 4,720,099 | 1/1988 | Carlson | 128/25 R |
| 4,856,192 | 8/1989 | Collins | 224/232 |

*Primary Examiner*—Henry J. Recla
*Assistant Examiner*—David J. Walczak
*Attorney, Agent, or Firm*—Harness, Dickey & Pierce

[57] ABSTRACT

A sink strainer assembly consisting of a body member of upright tubular shape having a lower portion connected to a drain and a larger upper portion joining to the lower portion so as to form a seat. A grid is mounted in the lower portion below the seat and a strainer basket is concentrically disposed within the upper portion. An upright plastic post is secured to said basket and a spring pressed ball member is mounted in the post so that it extends transversely outwardly at a position adjacent the lower end of the post. A resilient stopper secured to the bottom side of the strainer basket is movable into sealing engagement with the seat in a position of said post extending downwardly through said grid opening and with said ball engaging the underside of said grid so as to restrain upward movement of said post, and enable the stopper to be moved upwardly away from the seat by manual lifting of the post so as to cause the ball to be moved against the spring to a release position in the post.

2 Claims, 1 Drawing Sheet

FIG. 1
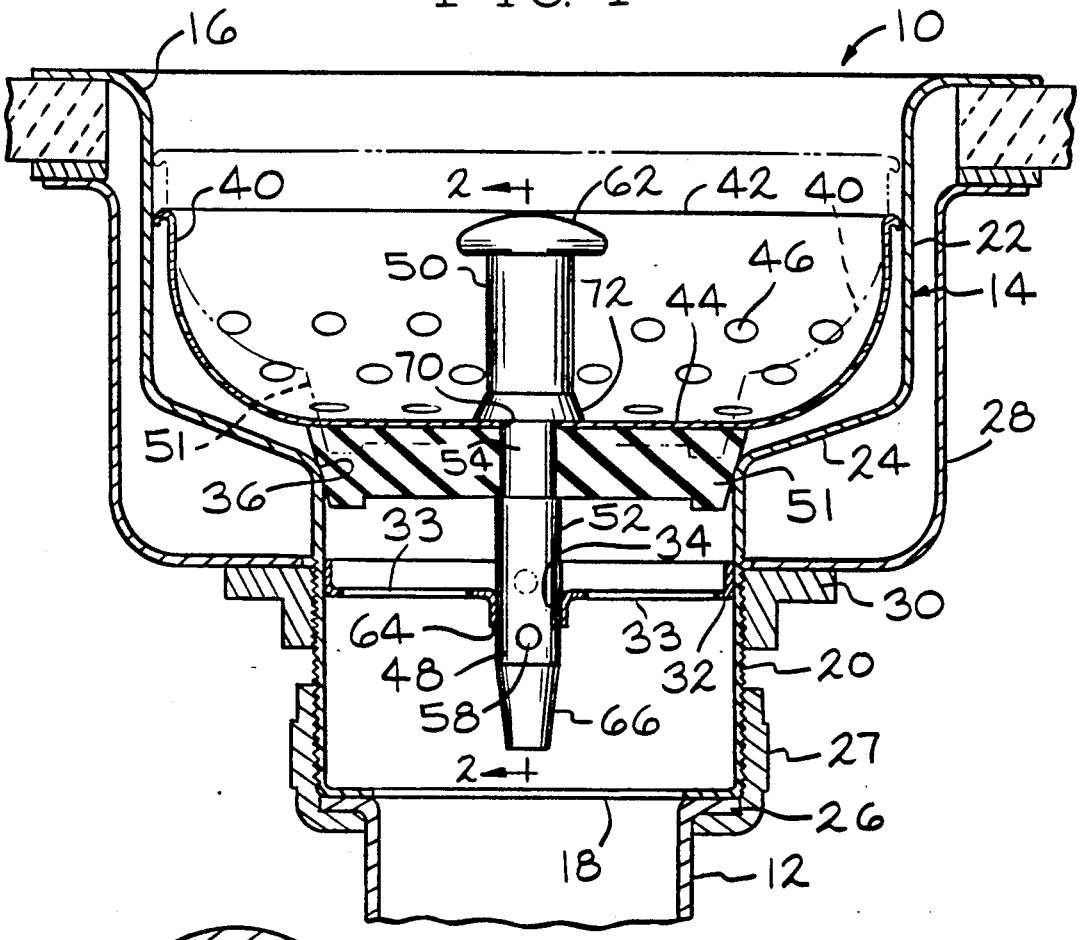
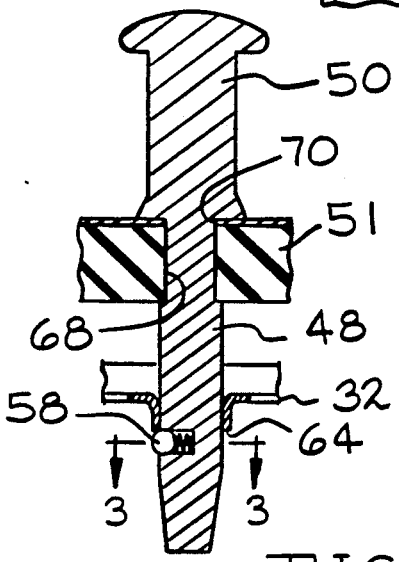
FIG. 2
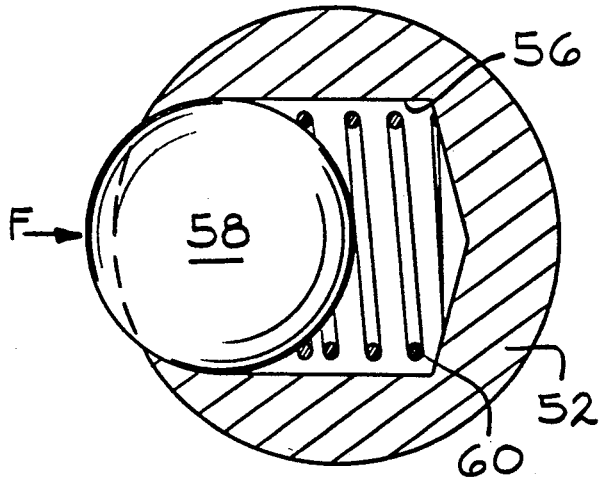
FIG. 3

SINK STRAINER ASSEMBLY WITH SNAP LOCK

BACKGROUND AND SUMMARY

Sink strainer assemblies are commonly used in household sinks to strain the waste water that flows from the sink into the associated drain pipe and to stop the flow of water from the sink into the drain pipe so that water can be retained in the sink for dishwashing or other purposes. Prior sink strainer assemblies have not been totally satisfactory from the standpoint of reliability of holding water in the sink, reliability of operation, and cost of manufacture and assembly.

It is an object of the present invention, therefore, to provide an improved sink strainer assembly which is provided with a snap lock for maintaining the strainer assembly in a position blocking the flow of waste water into the drain pipe.

The sink strainer assembly of this invention is adapted to be connected to the upper end of the drain pipe and comprises a body member of upright tubular shape having a lower portion positioned in fluid communication with the upper end of the drain pipe, and an upper portion of a larger diameter than the lower portion. The strainer basket is positioned in the larger upper portion.

An upright post secured to the basket and extending both upwardly and downwardly from the bottom wall of the basket carries a spring pressed ball near its lower end for locking a stopper on the under side of the bottom wall of the basket in a position preventing flow of water from the body member into the drain pipe. To ensure sealing of the stopper, it is made of a resilient material such as rubber and the body member is shaped so as to form a seat at the juncture of the larger upper portion of the body with the smaller lower portion of the body.

A grid mounted in the lower portion of the body below the seat has an axial opening through which the post extends and when the post is pushed downwardly so as to seat the stopper on the body member, the spring pressed ball passes through the opening in the grid and snaps into retaining engagement with the under side of the grid when the post is released. This maintains the stopper in sealing engagement with the body member.

The post can conveniently be made of an inexpensive plastic material which is readily shaped to accept the spring pressed ball and formed with a convenient handle projecting upwardly into the strainer basket. The post is subjected to principally compressive stresses which enables it to be manufactured of plastic which is of lower strength than metal.

The seat on the body member is curved and rounded to facilitate sealing engagement with the stopper which is also tapered to facilitate its sealing engagement with the seat.

All of the above features cooperate to provide an improved sink strainer assembly which can be economically manufactured and used over a prolonged service life.

Further objects, features and advantages of the invention will become apparent from a consideration of the following description when taken in connection with the appended claims and the accompanying drawing.

BRIEF DESCRIPTION OF THE DRAWING

FIG. 1 is a vertical sectional view of the sink strainer assembly of this invention shown in assembly relation with a drain pipe, the assembly components being shown in full lines in a position preventing flow of water into the drain pipe and in broken lines in a position enabling full flow of water into the drain pipe.

FIG. 2 is a vertical sectional view of the one-piece post in the sink strainer of this invention, as seen from substantially the line 2—2 in FIG. 1; and FIG. 3 is an enlarged transverse sectional view showing the spring mounted snap lock ball in the one-piece post, as seen from substantially the line 3—3 in FIG. 2.

DETAILED DESCRIPTION OF THE DRAWING

With reference to the drawing, the sink strainer assembly of this invention, indicated generally at 10, is illustrated in FIG. 1 in assembly relation with an upright drain pipe 12, only the upper end portion of which is shown. The sink strainer assembly 10 includes a body member 14 of generally upright tubular shape and open at its upper and lower ends 16 and 18, respectively. As shown in FIG. 1, the body member 14 has a lower end portion 20 of small diameter and an upper portion 22 of larger diameter. An intermediate portion 24 connects the portions 20 and 22. The lower end of the lower portion 20 is connected to a flange 26 on the upper end of the pipe 12 by a tail nut 27 so that the lower end portion 20 of the body member 14 is in fluid tight communication with the drain pipe 12.

A retainer cup 28 is mounted on the lower body portion 20 at a position telescoped over the upper portion 22 by a lock nut 30. An annular grid member 32, with openings 33 and having an axial opening 34, is secured within the lower body portion 20 at a position in substantial radial alignment with the lower end of the retainer cup 28 as shown in FIG. 1. At the juncture of the body member portions 20 and 24, the body member 14 forms a seat 36 which is of rounded curved shape so that it presents an upwardly and outwardly tapered surface on which a stopper or plug can seat to block and positively prevent flow of liquid downwardly through the lower body portion 20 into the drain pipe 12, as will more clearly appear hereinafter.

A strainer basket 40 of generally cup shape having an open end 42, a generally flat bottom wall 44 and a multitude of strainer openings 46 is positioned concentrically within the upper body portion 22. A one-piece post member 48 is secured to and extends through the bottom wall 44 of the basket, as shown in FIG. 1. The portion 50 of the post 48 that is above the bottom wall 44 constitutes a handle for moving the basket 40 up and down within the body member 14. A stopper or plug member 51, formed of a resilient material such as rubber, is mounted on the portion 52 of the post 48 that is disposed below the basket bottom 44. As shown in FIGS. 1 and 2, the post portion 52 has a reduced diameter portion 54 located adjacent the basket bottom 44 and the resilient stopper member 51 is tightly mounted on the post portion 54 so that it is in engagement with the under side of the basket bottom wall 44.

An opening 56 (FIG. 3) is formed in one side of the post portion 52 at a position below the stopper 51 and a snap lock ball member 58 is mounted in the opening 56 so that it will project from one side of the post portion 52. As shown in FIG. 3, a coil spring 60 is mounted in the cavity 56 so that it will exert spring pressure on the ball member 58 urging it to the position shown in FIG. 3 in which the ball member 58 projects outwardly from one side of the post portion 52 but is movable against the pressure of spring 60 to a position in which it does not project transversely outwardly from the post portion 52.

In the use of the sink strainer assembly 10 of this invention, assume that the strainer basket 40 is in the position shown in solid lines in FIG. 1 in which the stopper member 51 is in fluid tight engagement with the seat 36. In this position of the strainer basket 40, waste water from the sink in which the assembly 10 is installed is retained in the sink because it cannot flow into the drain pipe 12 by virtue of the seated position of the stopper 51 on the seat 36.

Now assume that it is desired to release the water from the sink. The handle 50 is manually grasped and an upward pull is applied to the post 48. The provision of a transversely outwardly projecting cap 62 on the post 48 facilitates the application of a pulling force to the handle 50. This force must be of a magnitude sufficient to result in the application of a horizontal force F (FIG. 3), on the ball 58 of a magnitude adequate to push the ball 58 rearwardly into the cavity 56 to a position in which it does not project transversely outwardly from the post portion 52.

The post portion 52 can then be moved upwardly through the opening 34 and the grid member 32. The force F is applied to the ball 58 by the edge 64 of the grid member 32 at the opening 34 which engages the ball 58 in response to an upward pull on the post 48. The basket 40 can then be lifted to a position such as the position shown in broken lines in FIG. 1 in which the stopper member 51 is in a clearance relation with the seat 36 so that water can readily flow through the basket openings 46 and the body member 14 into the drain 12.

In order to return the stopper member 51 to its seated position on the seat 36, it is only necessary to manually grasp the handle cap 62 and move the stopper 51 downwardly into engagement with the seat 36 and then push downwardly until the ball 58 snaps through the opening 34 in the grid 32 and engages the underside of the grid 32, following which the handle 62 is released. The resilience of the rubber stopper 51 enables the user to readily accomplish this "snap-lock" manipulation of the post 48 and the ball 58.

From the above description, it is seen that this invention provides a sink strainer assembly 10 which, by virtue of the coaction of the rubber stopper 51 and the snap lock ball 58 provides the desired control of sink water in a quick and efficient manner. The construction of the post 48 is such that it can be economically constructed of plastic which also facilitates assembly of the post 48 with the basket 40 and the stopper 51. As shown in FIG. 1, the lower end of the post 48 has a tapered portion 66 so that the stopper can readily be assembled with the post 48 by moving the stopper 51 upwardly over the post portion 66 and into the reduced diameter portion 54 of the post 48. The central opening 68 in the stopper member 51 can readily be expanded over the post 48 by virtue of the construction of the stopper 51 of the resilient rubber material.

The post 48 is initially extended downwardly through a central opening 70 in the bottom wall 44 of the strainer 40 to a position in which a flange 72 on the post 48 engages the top side of the strainer bottom 44. The bottom 44 of the strainer is then clamped between the resilient stopper 51 and the flange 72. The entire assembly is facilitated by the use of the plastic material in the post 48 which has low friction characteristics.

I claim:

1. A sink strainer assembly for connection to the upper end of a drain pipe comprising:

a. a body member of upright tubular shape having a lower portion adapted to be positioned in fluid communication with the upper end of said drain pipe;

b. said body member having an upper portion adapted to be positioned in fluid communication with a drain opening in a sink, said upper portion being of a larger diameter than said lower portion, and said body member also having a portion joining said upper and lower portions forming a seat;

c. a grid mounted in said lower portion below said seat and having an axial opening;

d. a strainer basket substantially concentrically disposed within said upper portion;

e. an upright one-piece post secured to said basket and extending substantially axially thereof said post having a section extending from a lower surface of a bottom wall of said basket in sliding engagement with said axial opening, a spring pressed ball member mounted in said section of said post and extending transversely outwardly thereof, and f. a resilient stopper mounted on said post and engaged with said lower surface of said strainer basket and adapted to sealingly engage with said seat, said ball member being located in said post with respect to said stopper such that as said post extends downwardly through said grid opening and said stopper engages said seat, said ball engages an underside of said grid so as to restrain upward movement of said post.

2. A sink strainer assembly according to claim 1 wherein said post is formed of a plastic material and a portion of said post extends upwardly above said basket bottom wall and forms a handle for moving said strainer basket up and down relative to said body member to thereby move said stopper into and out of sealing engagement with said seat, said post having a reduced diameter portion located adjacent and below said lower surface of said strainer basket, said resilient stopper having a central opening expanded over said post so that said resilient stopper is supported on said reduced diameter post portion at a position engaged with said lower surface of said strainer basket.

* * * * *